United States Patent [19]

Aste

[11] 4,394,173

[45] Jul. 19, 1983

[54] SPORTING AND RECREATIONAL FACILITY SLIDE

[75] Inventor: Christian Aste, Innsbruck, Austria

[73] Assignees: Horst Schwamm, Sistrans; Friedbert Pezzei, Grinzens, both of Austria

[21] Appl. No.: 258,274

[22] Filed: Apr. 28, 1981

[30] Foreign Application Priority Data

May 5, 1980 [AT] Austria ..... 2368/80
May 5, 1980 [AT] Austria ..... 2372/80

[51] Int. Cl.[3] ..... A63G 21/00; A63G 25/00; A63G 21/04

[52] U.S. Cl. ..... 104/69; 272/56.5 R; 104/125; 104/124

[58] Field of Search ..... 104/69, 70, 125, 124, 104/126, 118, 119, 120, 134, 135, 136; 272/56.5 R; 193/2 A, 2 R, 27, 33

[56] References Cited

U.S. PATENT DOCUMENTS 3,343,793 9/1967 Waser ..... 193/2
4,211,400 7/1980 Ray ..... 104/69
4,221,170 9/1980 Kovoelka ..... 104/69

FOREIGN PATENT DOCUMENTS 7239729 8/1973 Fed. Rep. of Germany .
3236325 7/1975 Fed. Rep. of Germany .
2731837 2/1979 Fed. Rep. of Germany .

*Primary Examiner*—Robert B. Reeves
*Assistant Examiner*—James Barlow
*Attorney, Agent, or Firm*—Wenderoth, Lind & Ponack

[57] ABSTRACT

Intermediate regions are provided between straight and circular-arc slide sections having a curved sliding surface in cross-section, the intermediate regions being clothoid-shaped in top view. In an intermediate region, which starts with a quarter-elliptic cross-section of the sliding surface at the outer side of the curve corresponding to the cross-sectional shape of the straight slide section, the ratio between the major and the minor axes of the ellipse continuously changes towards the other end so that individual trajectories depending on the velocity of the vehicle form in top view a sheaf of clothoids having the same initial point. The individual structural elements of the slide are flanged at their ends, one flange, each, of two structural elements being adjustable in various directions and supported by a strut.

7 Claims, 11 Drawing Figures

SPORTING AND RECREATIONAL FACILITY SLIDE

BACKGROUND OF THE INVENTION

1. Field of the Invention

The present invention relates to a roller slide or slide, particularly for descending in unsteered vehicles, such slide comprising straight sections and circular-arc-sections, when viewed from the top, the cross-section of the track sections being of curved configuration.

2. Description of the Prior Art

A slide of the afore-mentioned kind has, for example, been described in AT-PS No. 323,625 and is generally made of straight and circular-arc structural elements. The straight and circular-arc structural member have a sliding surface of circular-arc cross-section. The cross-section of a structural element having the shape of a circular arc, when viewed from the top, has been illustrated in DGM No. 7 239 729. As further shown therein, the slide is banked on the outer sides of the curves. The vehicles used on such slides are generally sleds gliding on skids, and cars rolling on wheels have also been suggested.

The configuration of such tracks has proved unsatisfactory in various aspects. The vehicle may turn over, particularly when unskilled passengers drive into curves which are circularly arced, when viewed from the top. When driving out of the curves, a lurching movement of the vehicle may be ovserved.

SUMMARY OF THE INVENTION

It is, therefore, the object of this invention to improve a slide of the above-described kind in that a vehicle, particularly an unsteered or not voluntarily steered vehicle moves without lateral forces on a theoretically correct, 3-dimensional track. It should, thus, be avoided, even in case of driving errors, that the vehicle is thrown off the slide or turns over. A person sitting on the vehicle should be able to descend harmonically without lurching, regardless of speed.

It is known that the ideal trajectory of a vehicle turning from a straight line into a curve is a clothoid, as the centrifugal force does not suddenly increase in such case. This has for a long time been taken into account in road and railway construction.

It is by no means trivial to apply the experience of road- and railway construction in the construction of roller slides. Here, vehicles arriving at the end of a straight section of the track at entirely different speeds should move into the circular-arc track section at the right height and tangentially thereto, and vehicles moving out of the circular-arc track section at different speeds should be directed into the following straight section of the track. Prior art bobsled- and toboggan rides have made almost no suggestion for the solutation of this task as such rides have been deliberately constructed in such a manner that an ideal trajectory is only obtained by steering the vehicle.

According to the invention, clothoid-shaped trajectories are provided for different running speeds by combining track sections of elliptic and circular-arc cross-sections, such cross-sections as such being well known in the art.

Hence, the invention is characterized in that the sliding surface at the outer side of the curve has in the clothoid-shaped intermediate region between the straight and the circular-arc slide sections a continuously changing cross-sectional shape, such cross-sectional shape being at one end a quarter of an ellipse corresponding to the cross-sectional shape of the straight slide section and the ratio between the major and minor semi-axes of the ellipse continuously decreasing towards the other end.

The slide according to the invention shall ensure that vehicles which may run at different speed are directed through the curves without lateral forces. By means of such track profile, the inclined position of the vehicle continuously increases so that at any speed the resultant of the weight and the centrifugal force of the loaded vehicle runs normally to the tangent to the track.

The vehicle descends continuously in the final section of the curve and slides without jerks into the adjacent straight track section.

It is preferably provided that the cross-section of the sliding surface of an intermediate region at the joint with a straight track section is half an ellipse divided at its substantially horizontal major axis, and that preferably the major axis is twice as long as the minor axis.

This cross-section which continues in the straight sections has proved particularly advantageous in that lurching of the vehicle caused by driving errors are quickly stabilized after curves as the vehicle uses up a considerable amount of energy, when approaching the verge of the track.

In order to avoid thermal deformation, the roller slide preferably consists of a number of channel-shaped structural elements connected to one another at their joints and supported at the joints by rigidly anchored struts.

Such slides for descending in sliding sleds or the like have, for example, been described in AT-PS No. 323.625. Each structural element is downwardly crimped on its upper joint, the lower end of the adjacent structural member resting on the crimped portion. Further, each structural element is immediately below its upper joint supported by two struts arranged in a transverse plane and engaging below shoulder-shaped marginal arcs. Such loose arrangement at the joints of the structural elements however has not proved satisfactory.

The present invention suggests a rigid connection at the joints of the structural elements allowing, however, a thermally induced movement of the elements.

Preferably the channel-shaped structural elements are provided at their joints with flanges extending from the convex side. The flanges are linked to one another by means of screws or the like, whereby an expansion gap is left between the flanges. The flanges further rest against the screws or the like and against plates through which the screws or the like extend by means of rubber-elastic cushions. Hence, the structural elements are unreleasably connected to one another without impeding changes in the length of the structural elements which are caused by changes in temperature.

The expansion gap is smallest at maximum temperatures and grows, when the structural elements cool off, whereby the cushions always ensure that the ends of the structural members are held tightly.

In a preferred embodiment the screws or the like are clamped against rigid spacer sleeves, spacing two disks from each other and penetrating the flanges in bores, the rubber-elastic cushions being arranged between the disks and the flanges. Such arrangement has the advantage that the dimension of the expansion gap is always the same and is independent of the skill of the fitters.

It is of particular advantage, if the channel-shaped structural elements are fastened to the struts by means of the screws or the like connecting the flanges. Hence, each strut carries two structural members and ensures the exact arrangement of their ends. This is not the case if the structural elements are supported at the bent longitudinal edges as, for example, described in AT-PS No. 323.625.

There the structural elements comprise a central trough-shaped member, upwardly arced members lying adjacent on both sides and adjacent thereto downwardly inclined side faces. Tube members are arranged underneath the shoulders of the structural elements obtained in the afore-described manner. Height-adjustable struts fixed to ties engage the tube members. This structure has the disadvantage that the substructure, particularly the construction of the ties, requires relatively precise and time consuming operations as their positions have to be precisely adapted to the curvature and position of the slide elements. The same disadvantage occurs if the structural elements are directly fastened to the ground by means of bolts, as described in DE-OS No. 2 731 837.

Regarding the mounting of the slide elements, it has already been suggested to fasten a supporting structure extending transversely to the longitudinal axis of the slide element to one single height-adjustable strut, the supporting structure engaging below the shoulders of the slide elements. In such case, the substructure requires less work but it is still required to arrange the strut precisely in the set path of the slide.

The present invention, however, preferably employs a strut which substantially reduces the time- and work consuming measurements required before the anchoring of the strut in the ground.

It is, therefore, provided that the supporting structure comprises a supporting member movable transversely to the longitudinal axis of the slide element and pivotally mounted on the strut on gimbals. Arms that carry the slide elements and are pivotable around the longitudinal axis of the supporting member are fastened to the ends of the supporting member.

By means of such struts it is possible to provisionally fasten the height-adjustable strut, which is substantially centrally and vertically arranged, in the longitudinal axis of the slide element in the ground and to adapt then the supporting structure precisely to the pre-set path of the slide. If the position of the strut is changed because of movements of the slope, such changes can be easily compensated.

BRIEF DESCRIPTION OF THE DRAWINGS

In the following an embodiment of the invention will be described in greater detail with reference to the accompanying drawings, without being limited thereto, and wherein thereto.

DESCRIPTION OF THE PREFERRED EMBODIMENT

Figure 1:
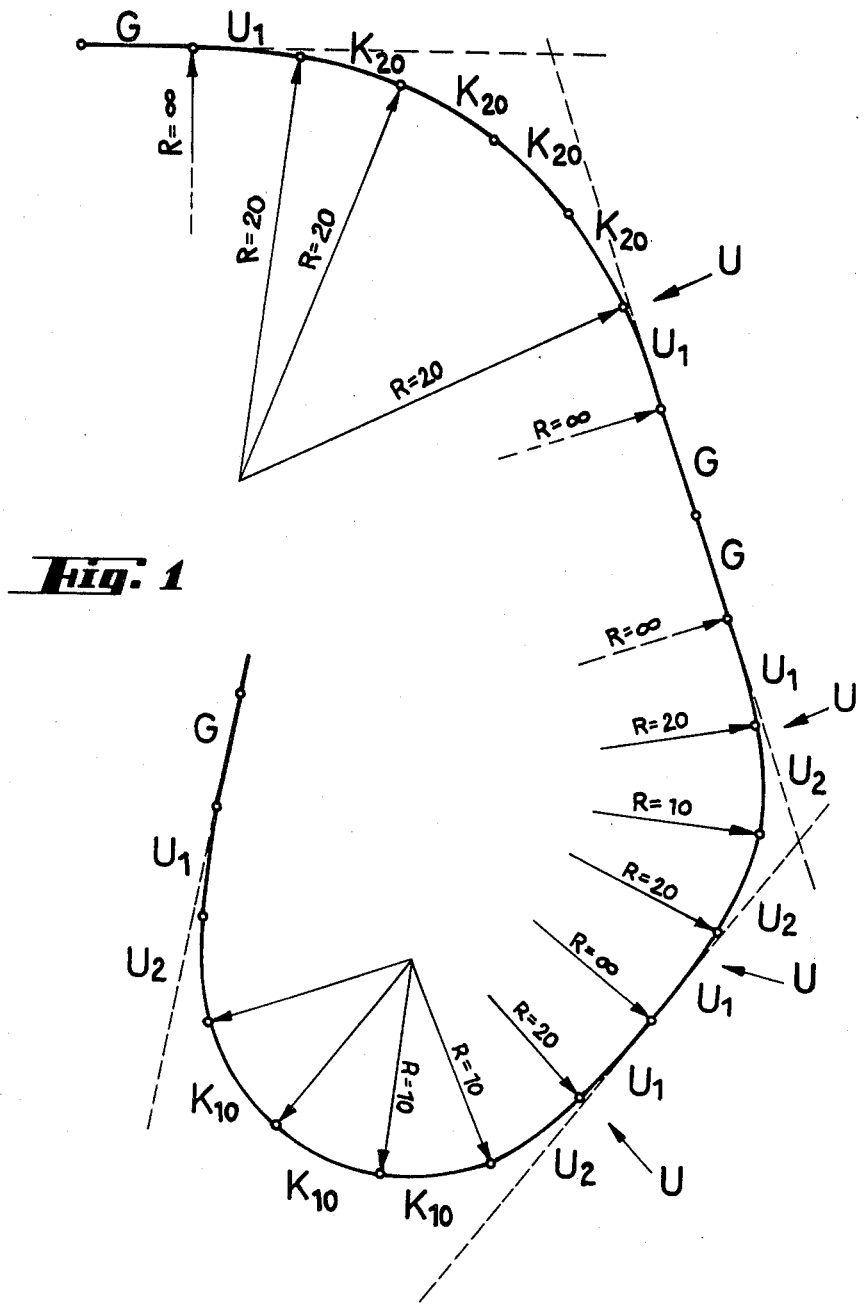
FIG. 1 is a diagrammatic top view illustrating the structural elements of the slide of the invention.

FIG. 1 shows a top view of a slide consisting of a number of structural elements and built on a slope seen in a direction normal to the plane of the slope. The structural elements may obviously also be curved normally to the plane of the slope in order to follow a natural shape of the slope. Such curvatures are, however, generally achieved with structural elements which are straight in top view.

When viewed from the top, the slide comprises straight slide sections G, circular-arc slide sections $K_{10}$ and $K_{20}$ and intermediate arcs $U_1$ and $U_2$. The intermediate arcs $U_1$ and $U_2$ are arranged between the circular-arc slide sections K and the straight slide sections G and are curves substantially in the shape of a clothoid.

When running on the slide, e.g. in a vehicle rolling on wheels, the centrifugal force continuously increases, when moving into the intermediate arcs $U_1$ and $U_2$, until the arced slide sections $K_{10}$ or $K_{20}$ are reached. Here, the centrifugal force remains constant, whereas it continuously decreases in the intermediate arcs, when sliding out of the curves. If, as illustrated, circular-arc slide sections of different radii of curvature are employed, e.g. the slide sections $K_{20}$ with a radius of curvature of 20 meters and the slide sections $K_{10}$ with a radius of curvature of 10 meters, four differently curved intermediate arcs will be required. Two mirror-inverted intermediate arcs $U_1$ allowing the connection between the straight slide sections and the arced slide sections $K_{20}$ and two mirror-inverted intermediate arcs $U_2$ providing the connection between the intermediate arcs $U_1$ and the sections $K_{10}$ have to be provided. The radii of curvature of the intermediate arcs can easily be determined as the arc length L is preset, and the clothoid parameter A is worked out according to the law $L=A^2/R$.

It is obvious that any sequence of curves may be formed by combining the afore-described structural elements as required.

Figure 2:
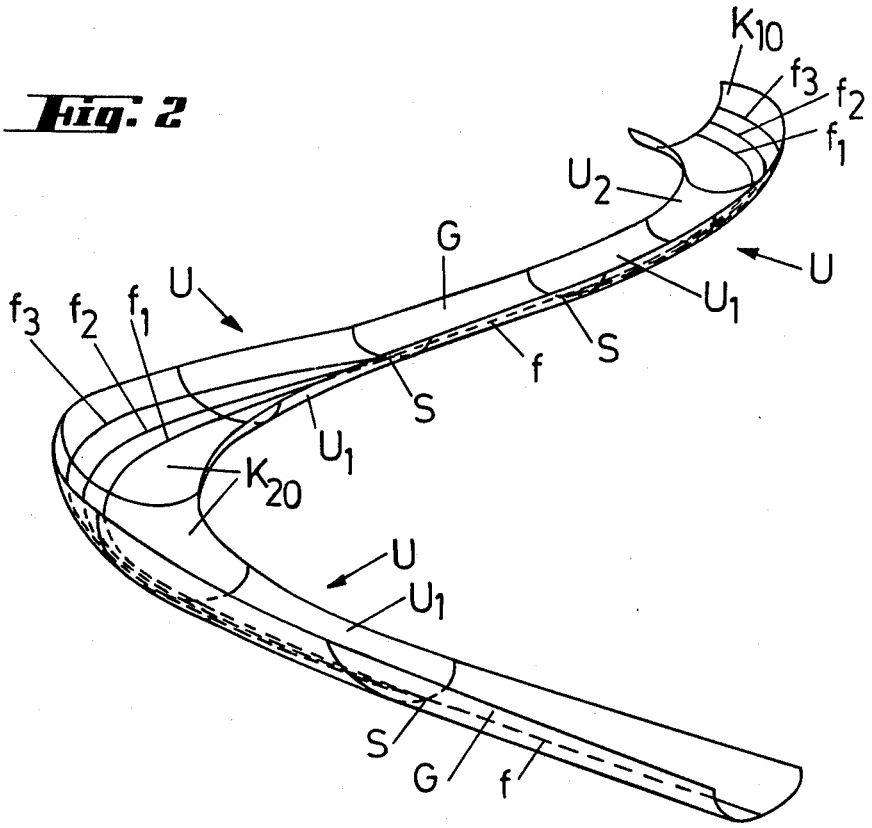
FIG. 2 is a perspective view of a slide with intermediate regions between straight slide sections and circular-arc slide sections, such intermediate region being clothoid-shaped in top view.

In the oblique view of a slide shown in FIG. 2 several trajectories $f_1$, $f_2$, $f_3$ for vehicles W with different velocities V have been illustrated in the curved sections $U_1$, $U_2$, K. Each of the trajectories $f_1$, $f_2$, $f_3$ is substantially a clothoid in top view. Each sheaf of clothoids has a common initial point S which always is positioned at the transition between a straight slide section G and an intermediate region U as the trajectories $f_1$, $f_2$, $f_3$ coincide in one trajectory f in the straight slide sections G. In the circular-arc slide sections K, the trajectories $f_1$, $f_2$, $f_3$ run parallel to one another.

Figure 3:
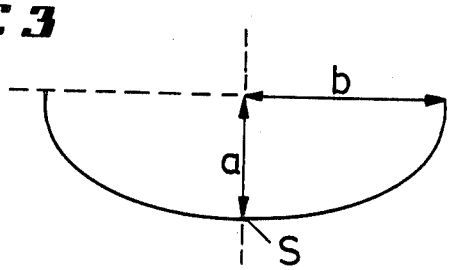
FIG. 3 is a cross-sectional view of an intermediate region at the joint with a straight slide section.

FIG. 3 shows the cross-section of the intermediate arc $U_1$ at the point of contact with the straight slide sections G. Such cross section is half an ellipse divided at its horizontal major axis b, the major axia b being about twice as long as the minor axis a. This cross-section also provides an optimal track profile for the straight slide sections as the curvature in the main track region is substantially constant, whereas any lurching movements of the vehicle W are quickly stabilized as the vehicle is forced to mount when approaching the verge of the slide.

As can be seen in FIG. 2, the elliptic parameters a and b of the sliding surface directed towards theouter side of the curve continuously change with the decreasing radius of curvature R of the intermediate arcs $U_1$ and $U_2$. The ratio (b/a) between the major axis b and the minor axis a decreases with the decreasing radius of curvature R.

Figure 4:
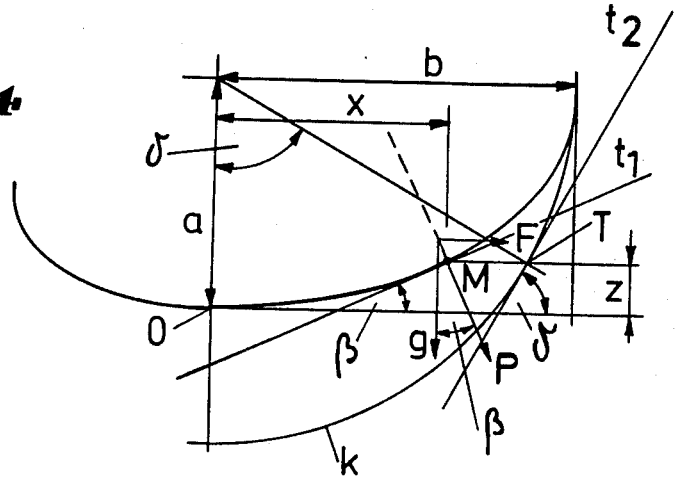
FIG. 4 is a cross-sectional view of the intermediate region substantially in the longitudinal center thereof.

FIG. 4 shows a cross-sectional view of the slide at the end of the intermediate arc $U_1$, an intermediate arc $U_2$ or a circular-arc slide section $K_{20}$ lying adjacent thereto.

The ratio (b/a) of the semi-axes of the ellipse has decreased. The resultant P from the weight g of the vehicle and the centrifugal force F, which is expressed in the relation ($MV^2/R$), extends through the point M, M being the mass of the vehicle, V being the velocity of the vehicle W and R the radius of curvature of the clothoid at point M in top view. The tangent $t_1$ to point M is at an angle $\beta$ with a horizontal line, angle $\beta$ corresponding to the angle between the resultant P and the line of force of the weight g, i.e. the inclined position. No transverse forces occur as the resultant P extends vertically to the tangent $t_1$ at point M of the trajectory. Hence, the coordinates (x, z) of point M of the trajectory have the following values in each area of cross section, the origin O lying at the lowest point of the area of cross section:

$$x\ (\text{absciss}) = b \cdot \sin \delta$$

$$z\ (\text{ordinate}) = a \cdot (1 - \cos \delta)$$

It is defined that: $\tan \delta = (b/a) \cdot \tan \beta \cdot (1/L)$, and $\tan \beta = (V^2/127R)$ Herein are as follows:

b = large semi-axis of the ellipse a = small semi-axis of the ellipse $\beta$ = angle between the resultant P at point M and the gravity g (inclined position of the vehicle)

$\delta$ = angle of inclination of a tangent $t_2$ at a point T of the external osculatory circle k to the ellipse with the radius b, point T having the ordinate z l = length of the clothoid from the initial point S to the point M L = length of the clothoid-shaped intermediate region U V = velocity in km/h R = radius of curvature of the clothoid at M In front view, each trajectory $f_1$, $f_2$, $f_3$ in the intermedate region U is the ascending branch of a sine curve starting at the initial point S at O. The ordinate z of each point M of a trajectory $f_1$, $f_2$, $f_3$ in the intermediate region U is, therefore, defined by the following function of the sine curve:

$$z = (Z/2) \cdot \{1 + \sin [\pi \text{ rad } ((1/L) - \tfrac{1}{2})]\}$$

Z is the maximal height of the trajectory $f_1$, $f_2$, $f_3$ at the transition to the circular-arc slide section $K_{10}$, $K_{20}$·1 and L are as above-indicated.

Figure 5:
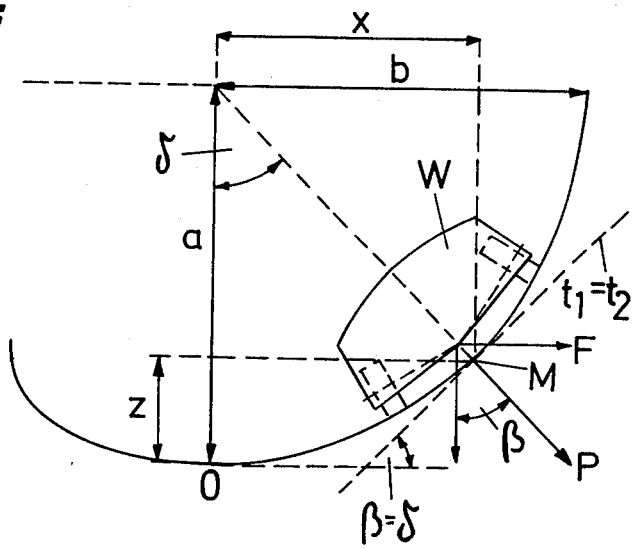
FIG. 5 is a cross section of the intermediate region at a joint with a slide section having the shape of a circular arc in top view.

FIG. 5 shows the cross-section at the joint between the intermediate arc $U_2$ and the slide section $K_{10}$ which is circularly arce-shaped in top view, the radius of curvature of $K_{10}$ being smaller than the radius of curvature of the slide section $K_{20}$. Here, the ratio between the major axis b and the minor axis a is such that the sliding surface is circularly arce-shaped in cross-section. The circular-arc cross-section of the sliding surface is preferably chosen for those circular-arc slide sections $K_{10}$ whose radius of curvature is a minimum. The slide section $K_{20}$ has a greater radius of curvature $R_{20}$, therefore, the cross-sectional shape is one quarter of an ellipse.

It is, however, also possible to provide those circular-arc slide sections having a small radius which are repeatedly required in the course of a slide with the circular-arc cross-section of the sliding surface. An individual slide section in which an even smaller radius of curvature of the circular-arc slide section is required could in such case have again a cross-sectional shape of one quarter of an ellipse, the ratio (b/a) being smaller than 1, i.e. the semi-axis b of the ellipse being shorter than the semi-axis a of the ellipse. Before and after such slide section $K_{<10}$ a further intermediate arc has to be arranged, the cross-sectional shape of such intermediate arc continuously changing from a circular arc at one end to one quarter of an ellipse, $(b/a) < 1$, at the other end.

In the embodiment illustrated in FIG. 5 of the circular-arc cross-section, the resultant P from the wieght g and the centrifugal force F extends vertically to the tangent $t_1$ to the sliding surface at point M, the angles $\beta$ and $\delta$ being equal and the tangents $t_1$ and $t_2$ (tangent to the point T of the osculatory circle, point T having the same ordinate z) coincide. The above-indicated formula for $\tan \delta$ is in such case reduced to $\tan \delta = \tan \beta V^2/127R$. As already mentioned, the ratios $(b/a) = 1$, $(1/L) = 1$, as the length 1 corresponds from the initial point to the point M to the total length L of the clothoids.

Depending on the sliding speed, the vehicle W moves on a trajectory $f_1$, $f_2$, $f_3$ being free of transverse forces, the cross-sectional profile of the sliding surface in the intermediate regions U according to the invention ensuring that the centrifugal force as well as the inclined position of the vehicle continuously change, when the vehicle slides into the curves and out of the curves.

Figure 6:
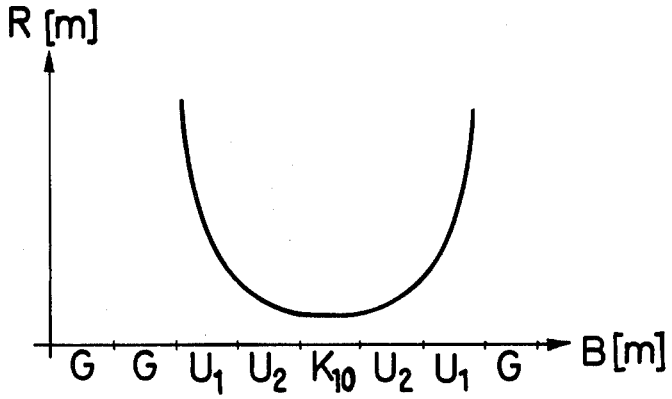
FIG. 6 is a graph showing the curvature of the slide according to the invention between two straight slide sections including an angle.
Figure 7:
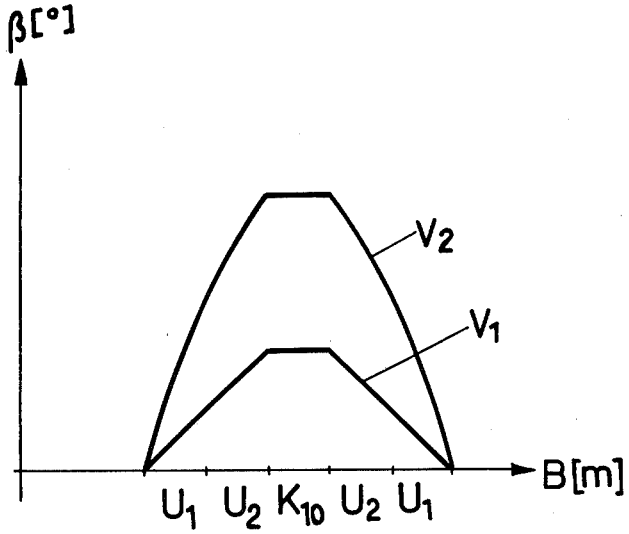
FIG. 7 is a graph showing the inclined path of a vehicle sliding through the curve.

FIG. 6 shows the radius of curvature R of the slide between two straight slide sections including an angle, whereas FIG. 7 shows that the inclined position of the vehicle W is continuously changed, when sliding through the intermediate arcs $U_1$ and $U_2$ at different speeds $V_1$ and $V_2$. This phenomenon can also be observed with respect to the centrifugal force. In FIG. 6 as well as in FIG. 7, the slide length B (in m) is the abscissa.

Figure 8:
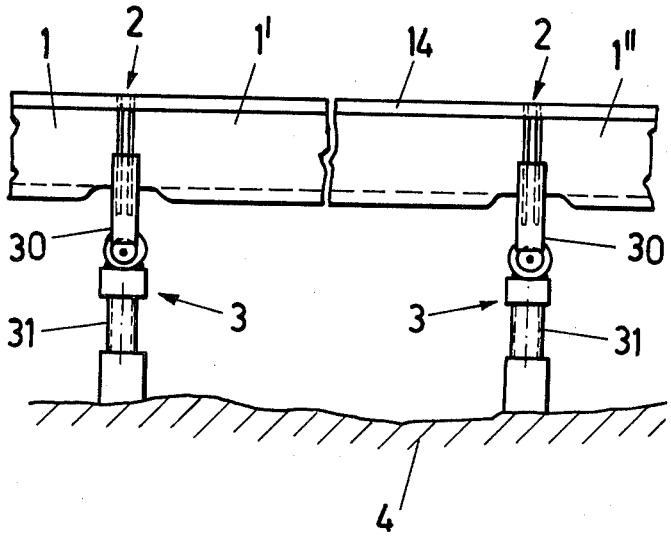
FIG. 8 is a partial side view of a part of the structural elements of the slide.

The section illustrated in FIG. 8 shows that the slide comprises a number of self-supporting, channel-shaped structural elements 1, 1', 1''. In such slide passengers can descend the slope either in sliding sleds, rollers cars or sitting directly on the sliding surface, whereby structural elements bent or curved about their longitudinal axis as well as about their transverse axis may be provided in order to adapt the slide to the terrain. The structural elements 1, 1', 1'' are supported at their joints by means of struts 3 anchored in the ground 4. strut 3 comprises a height-adjustable stay 31 arranged substantially centrally and vertically with respect to the longitudinal axis of the slide sections and retaining a supporting frame 30 extending transversely to the longitudinal axis of the slide element.

Figure 9:
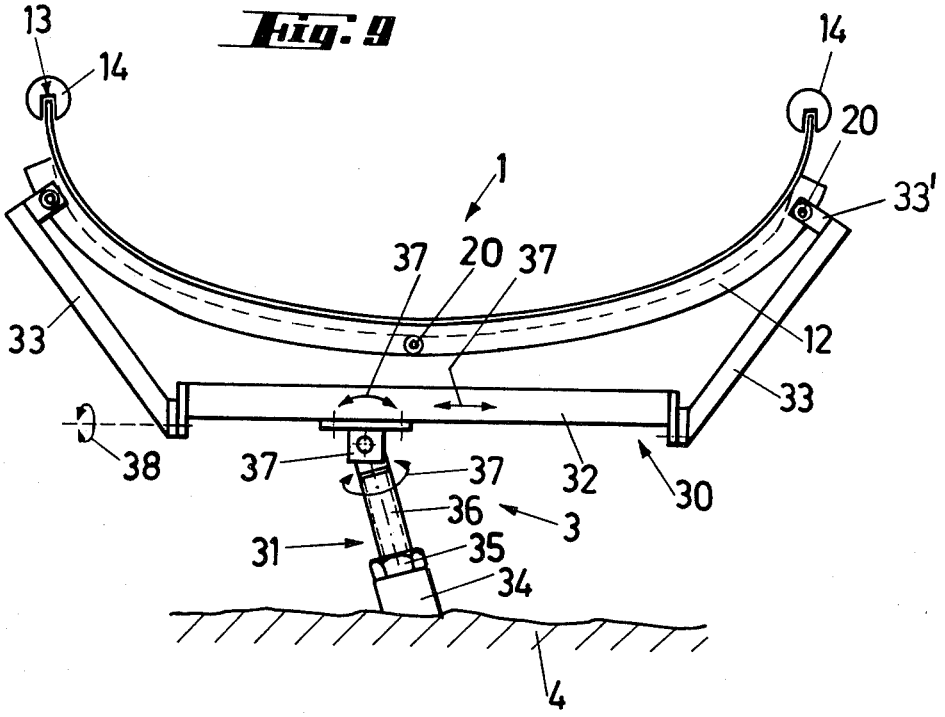
FIG. 9 is a front view of one such structural element and a strut supporting the element.
Figure 10:
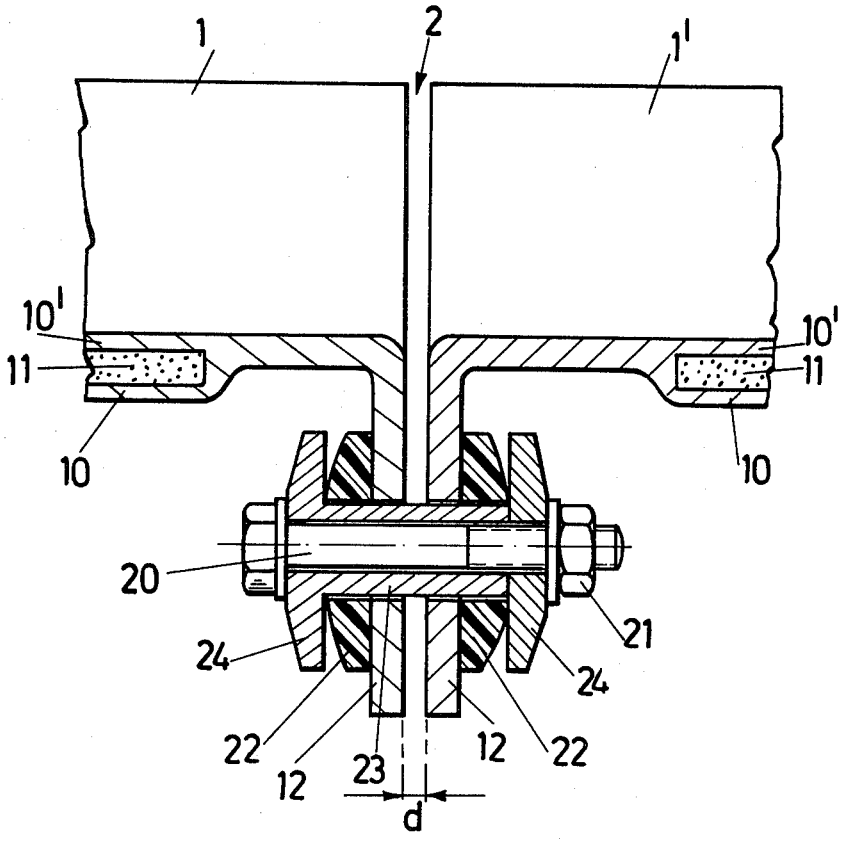
FIG. 10 is a longitudinal sectional view of two structural elements connected to each other at their joints.
Figure 11:
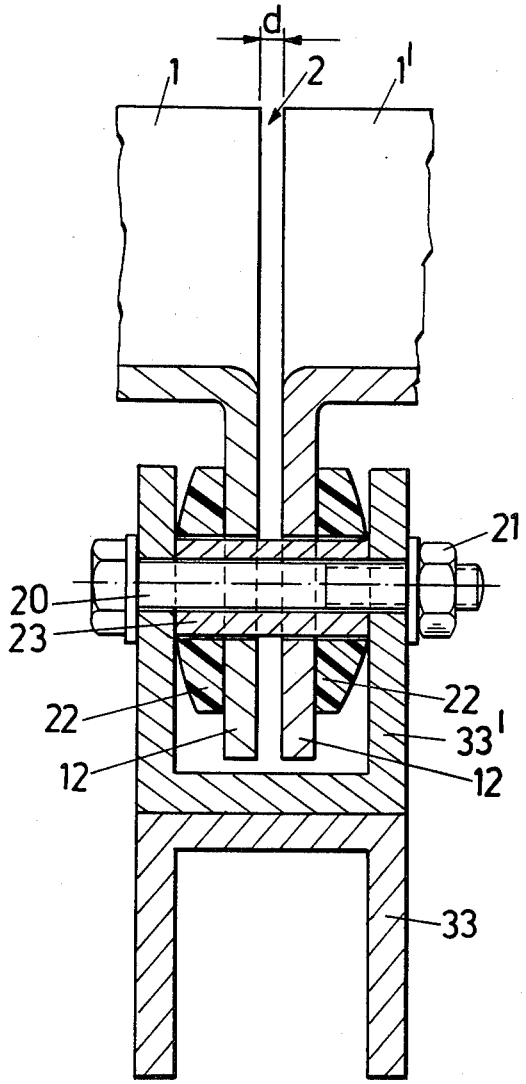
FIG. 11 is a sectional view according to FIG. 10 of the contact point of a strut.

As illustrated in FIG. 9, the straight structural elements 1 substantially have the cross-section of half an ellipse. Such cross-section is of particular advantage with respect to the stability of the structural elements as well as with respect to their guiding characteristics for a roller car or the like as the steeply ascending flanks swiftly damp any occuring lurching movements. The longitudinal edges 13 of the structural elements 1 are bordered by profiled members 14 covering the edges in the joints and compensating any occuring inaccuracies. Further, the structural elements 1 are at their joints provided with flanges 12 extending from the convex side, the struts 3 engaging in such flanges. The stay 31 of the strut 3 anchored in the ground 4 comprises a tube 34 having a nut 35 at its upper end. By means of nut 35 a threaded rod 36 is adapted to be height-adjustably fixed, a cardan joint 37 being arranged at the upper end of threaded rod 36. A supporting member 32 arranged transversely to the longitudinal axis of the structural elements is fixed to joint 37, supporting member 32 being adjustable in its longitudinal direction. Arms 33 pivotable about the longitudinal axis of the supporting member 32 are fixed to the ends of the supporting member. The flanges of the structural elements 1 are fastened to arms 33 in such a manner that minor changes in the length of the structural elements 1 are not impeded. It is obvious that the strut ensures easy displacement of the structural elements because of its numerous adjusting directions indicated by arrows 37 and 38. Any deviations of the stay 31 from the vertical line, as illustrated in FIG. 9, may easily be compensated, and also an inclined position of the structural elements 1 can easily be obtained. As illustrated in FIG. 10, the joints 2 of the structural elements 1 are spaced by an expansion gap d and connected to one another by screws 20 penetrating bores in the flanges 12. The screws 20 are inserted into spacer sleeves 23, disks 24 retained by a nut 21 being arranged at the ends of the sleeves. Rubber-elastic cushions 22 are arranged between the disks 24 and the flanges 12. This ensures that the structural elements are tightly connected at their joints without impeding changes in the length of the structural elements 1 caused by changes in temperature. The rubber-elastic cushions are pressed together, when temperatures fall, whereas the expansion gap d is reduced, when temperatures rise. As illustrated in FIG. 11, the arms 33 of the strut 3 are connected with the flanges 12 of the structural elements by means of the screws 20, i.e. by members 33' fastened to the arms 33.

What is claimed is:

1. A sporting or recreational slide, particularly for use with unsteered vehicles, said slide comprising:

a plurality of joined sections which form a sliding surface and which form regions which are, when viewed from above, straight regions, circular-arc regions and clothoid-shaped intermediate regions between and joining adjacent straight and circular-arc regions;

said intermediate region having a first end at said straight region and a second end at said circular-arc region; and said sliding surface at the outer curved side of said intermediate region having a cross-sectional shape which continuously changes between said first and second ends, said cross-sectional shape at said first end comprising a quarter of an ellipse corresponding to the cross-sectional shape of said sliding surface at said straight region, and the ratio between the major axis and the minor axis of the ellipse continuously decreasing toward said second end.

2. A slide as claimed in claim 1, wherein said cross-sectional shape at said second end comprises a circular arc portion corresponding to the cross-sectional shape of said circular-arc region.

3. A slide as claimed in claim 1, wherein the cross-sectional shape of the entire said sliding surface at said first end comprises one half of said ellipse divided at a horizontal said major axis thereof, and wherein said major axis is approximately twice said minor axis.

4. A slide as claimed in claim 1, wherein said sections comprise individual structural elements having flanges extending from the convex sides at the ends thereof, and further comprising struts engaging said flanges for supporting said slide.

5. A slide as claimed in claim 4, wherein each said strut comprises a height-adjustable stay substantially centrally and vertically arranged with respect to the longitudinal axis of said sections of said slide, a supporting structure mounted on said stay and extending substantially normally to said longitudinal axis, a pivotable supporting member movable transversely to said longitudinal axis and mounted on said stay, and arms supporting said structural elements and pivotable around the longitudinal axis of said supporting member fixed to opposite ends of said supporting member.

6. A slide as claimed in claim 4, wherein said flanges are fixed to one another by means of screws with an expansion gap between said flanges, said flanges and plates traversed by said screws having therebetween rubber-elastic cushions.

7. A slide as claimed in claim 6, wherein said screws are clamped against rigid spacer sleeves spacing two disks from one another, said spacer sleeves traversing bores in said flanges, and said rubber-elastic cushions being arranged between said disks and said flanges.

* * * * *